US007415233B2

(12) United States Patent
Ohta et al.

(10) Patent No.: US 7,415,233 B2
(45) Date of Patent: Aug. 19, 2008

(54) PLATE-SHAPED PEELING MEMBER AND METHOD AND APPARATUS OF MANUFACTURING SAME

(75) Inventors: Yukio Ohta, Mie (JP); Satoru Fukuzawa, Mie (JP); Masaaki Ohashi, Mie (JP); Kazuo Hirose, Mie (JP)

(73) Assignee: NTN Corporation, Osaka (JP)

( * ) Notice: Subject to any disclaimer, the term of this patent is extended or adjusted under 35 U.S.C. 154(b) by 187 days.

(21) Appl. No.: 10/996,794

(22) Filed: Nov. 24, 2004

(65) Prior Publication Data

US 2005/0117941 A1 Jun. 2, 2005

(30) Foreign Application Priority Data

Nov. 27, 2003 (JP) ..... P2003-397116

(51) Int. Cl.
*G03G 15/20* (2006.01)

(52) U.S. Cl. ..... 399/323

(58) Field of Classification Search ..... 399/323
See application file for complete search history.

(56) References Cited

U.S. PATENT DOCUMENTS

| | | | | |
|---|---|---|---|---|
| 4,144,110 | A | 3/1979 | Luc | |
| 5,216,069 | A | 6/1993 | Kobori | |
| 5,441,811 | A | 8/1995 | Lin et al. | |
| 6,236,829 | B1 | 5/2001 | Uehara et al. | |
| 2002/0031648 | A1 | 3/2002 | Ohashi | |
| 2003/0210933 | A1 * | 11/2003 | Mouri et al. | 399/323 |
| 2005/0254865 | A1 * | 11/2005 | Katayanagi | 399/324 |

FOREIGN PATENT DOCUMENTS

| | | |
|---|---|---|
| JP | 11-184300 | 7/1999 |
| JP | 2001-235959 | 8/2001 |
| JP | 2003-122174 | 4/2003 |

* cited by examiner

*Primary Examiner*—Vincent Q. Nguyen
*Assistant Examiner*—Amy He
(74) *Attorney, Agent, or Firm*—James V. Costigan; Hedman & Costigan, P.C.

(57) ABSTRACT

A plate shaped peeling member, which can be used for a long term, is manufactured by a method which is superior in productivity and is capable of manufacturing plate-shaped peeling members of consistent quality. The plate-shaped peeling member peels paper from a roller or a belt of an electrophotographic apparatus, by means of a leading edge of a thin metal plate that is in contact with or is adjacent to the roller or the belt. In the plate-shaped peeling member, an adhesive agent-applied resin sheet is adhered to the thin metal plate in a longitudinal direction thereof without pulling both end portions of the adhesive agent-applied resin sheet in a longitudinal direction thereof, with metal exposed at both end surfaces of the thin metal plate in the longitudinal direction thereof.

5 Claims, 6 Drawing Sheets

PLATE-SHAPED PEELING MEMBER AND METHOD AND APPARATUS OF MANUFACTURING SAME

BACKGROUND OF THE INVENTION

The present invention relates to a plate-shaped peeling member for peeling paper from fixing members such as a fixing roller, a fixing belt, and the like installed in an electrophotographic apparatus such as a copy machine and a laser beam printer and a method and an apparatus for manufacturing the plate-shaped peeling member.

Electrophotographic apparatuses such as a copy machine and a laser beam printer includes a heating/fixing apparatus for developing electrostatic latent images formed on a photosensitive drum on paper with a developer such as toner, and then fixing them. The heating/fixing apparatus has a fixing member such as a fixing roller and a fixing belt for fusing the developer by heating it and pressurizing the developer.

Conventionally, separation pawls for smoothly peeling developer-fixed paper from the roller or the like are disposed on the fixing member and on a pressurizing roller for pressing paper against the fixing member. In recent years, there is a tendency for the plate-shaped peeling member capable of accomplishing a line contact with the roller and the belt to be used instead of the separation pawl.

For example, in the peeling plate disclosed in Japanese Laid-Open Patent Publication No. 2001-235959, through the silicone based adhesive agent, the fluororesin sheet is stuck to the portion of the metal plate which contacts or is proximate to the fixing member such as the fixing roller and the fixing belt. The peeling plate has excellent paper-peeling property, durability against-high temperature, and anti-tacking property to toner.

The plate-shaped peeling member is disclosed in Japanese Laid-Open Patent Publication No. 2003-122174. The plate-shaped peeling member has the base member and the fluororesin sheet stuck thereto. To obtain the plate-shaped peeling member in which the generation of wrinkles and bubbles in the fluororesin sheet is suppressed to a possible highest extent, the edge forming the one side of the flat plate-shaped base material and its periphery are sandwiched by the fluororesin sheet in such a way that the fluororesin sheet is rolled on the edge forming the one side of the flat plate-shaped base material and the pulling portion is provided at both ends of the edge forming the one side of the flat plate-shaped base material. Further by pulling both ends of a pulling portion, the portion of the base material sandwiched by the upper and lower portion of the fluororesin sheet is pressurized, with a tensile force being applied to the fluororesin sheet. In the above-described manner, the fluororesin sheet is adhered to the base material.

However, in the plate-shaped peeling member obtained by the above-described method, the fluororesin sheet is adhered to the base material, with a tensile force being applied to the fluororesin sheet. Thus when the adhesive force deteriorates because the plate-shaped peeling member is used for a long time, the fluororesin sheet contracts and toner is attached to an exposed adhesive agent. This results in stains on paper that contacts the peeling member.

SUMMARY OF THE INVENTION

It is an object of the present invention to provide a plate-shaped peeling member which can be used for a long time and is manufactured by a method which is superior in productivity and capable of manufacturing plate-shaped peeling members not having variations in quality.

The present invention provides a plate-shaped peeling member having a thin metal plate and a resin sheet adhered thereto by winding the resin sheet around a leading edge of the thin metal plate. The plate-shaped peeling member peels paper from a roller or a belt of an electrophotographic apparatus, with a leading edge of the thin metal plate in contact with or being adjacent to the roller or the belt. In the plate-shaped peeling member, the adhesive agent-applied resin sheet is adhered to the thin metal plate in a length a little shorter than that of the thin metal plate in a longitudinal direction thereof without pulling both end portions of the adhesive agent-applied resin sheet in a longitudinal direction thereof, with a metal ground exposed at both end surfaces of the thin metal plate in the longitudinal direction thereof.

The present invention provides a method for manufacturing a plate-shaped peeling member having a thin metal plate and a resin sheet adhered thereto by winding the resin sheet around a leading edge of the thin metal plate. The plate-shaped peeling member peels paper from a roller or a belt of an electrophotographic apparatus, with a leading edge of the thin metal plate in contact with or being adjacent to the roller or the belt.

The method includes the steps of adhering an adhesive agent-applied resin sheet to one main surface of a thin metal plate without pulling both end portions of the adhesive agent-applied resin sheet in a longitudinal direction thereof, with an non-adhered portion left on the adhesive agent-applied resin sheet in a widthwise direction thereof and with the adhesive agent-applied resin sheet being pressurized in a longitudinal direction thereof; temporarily adhering the unstuck portion left on the adhesive agent-applied resin sheet in the widthwise direction thereof to other main surface thereof by folding back the non-adhered portion along a leading edge of the thin metal plate toward the other main surface thereof without pulling the both end portions of the adhesive agent-applied resin sheet in the longitudinal direction thereof; and fixing the temporarily non-adhered portion of the adhesive agent-applied resin sheet to the other main surface of the thin metal plate, while the non-adhered portion is being pressurized in the longitudinal direction of the adhesive agent-applied resin sheet from approximately a center of the adhesive agent-applied resin sheet in the longitudinal direction thereof.

The apparatus of the present invention for manufacturing a plate-shaped peeling member comprising a thin metal plate; and a resin sheet adhered to said thin metal plate by winding said resin sheet around a leading edge of said thin metal plate;

wherein an adhesive agent-applied resin sheet is adhered to said thin metal plate in a length a little shorter than that of said thin metal plate in a longitudinal direction thereof without pulling both end portions of said adhesive agent-applied resin sheet in a longitudinal direction thereof, with a metal ground exposed at both end surfaces of said thin metal plate in said longitudinal direction thereof wherein said apparatus for manufacturing said plate-shaped peeling member includes a first means for taking out a resin sheet-including product from a placing base after an operation of a fourth means finishes and mounting a thin metal plate joined with a supporting member or the thin metal plate on the placing base; a second means for sticking an adhesive agent-applied resin sheet to one main surface of a thin metal plate without pulling both end portions of an adhesive agent-applied resin sheet in a longitudinal direction thereof, with an non-adhered portion left at an end portion of the adhesive agent-applied resin sheet in a widthwise direction thereof and with the adhesive agent-applied resin sheet being pressurized in a longitudinal direction thereof; a third means for temporarily sticking the unstuck portion left on the adhesive agent-applied resin sheet in the widthwise direction thereof to other main surface thereof by folding back the non-adhered portion along a leading edge of the thin metal plate toward the other main surface thereof without pulling the both end portions of the adhesive agent-applied resin sheet in the longitudinal direction thereof; and a fourth means for fixing the temporarily non-adhered portion of the adhesive agent-applied resin sheet to the other main surface of the thin metal plate, while the non-adhered portion is being pressurized in the longitudinal direction of the adhesive agent-applied resin sheet from approximately a center of the adhesive agent-applied resin sheet in the longitudinal direction thereof.

In the manufacturing apparatus, the first through fourth means are so disposed as to surround four sides of a square stand respectively. In the manufacturing apparatus, a rotary body having sides corresponding to the four sides of the square stand respectively is mounted on the square stand. When the rotary body rotates 90 degrees, operations of the first through fourth means are sequentially performed.

In the plate-shaped peeling member of the present invention, both ends of the adhesive agent-applied resin sheet in its longitudinal direction are not pulled in adhering the adhesive agent-applied resin sheet to the thin metal plate. Therefore the resin sheet does not contract. Even when the adhesive force deteriorates, the resin sheet does not contract. Thus it is possible to prevent toner from staining paper for a long time. The adhesive agent-applied resin sheet is adhered to the thin metal plate in a length a little shorter than that of the thin metal plate in a longitudinal direction thereof, with the metal ground exposed at both end surfaces of the thin metal plate in the longitudinal direction thereof. Therefore the adhesive agent does not extend out from the resin sheet or is not exposed. Thus it is possible to prevent toner from staining paper.

Since the method of manufacturing the plate-shaped peeling member of the present invention has the above-described processes, the method is capable of suppressing the generation of wrinkles and bubbles in the resin sheet to a possible highest extent.

The apparatus for manufacturing the plate-shaped peeling member has the first means, the second means, the third means, and the fourth means so disposed as to surround the four sides of the square stand respectively. Therefore the apparatus is capable of manufacturing the plate-shaped peeling member at a high efficiency even in a small space. Hence the apparatus has a high productivity.

DETAINED DESCRIPTION OF THE PREFERRED EMBODIMENTS

Figure 1A:
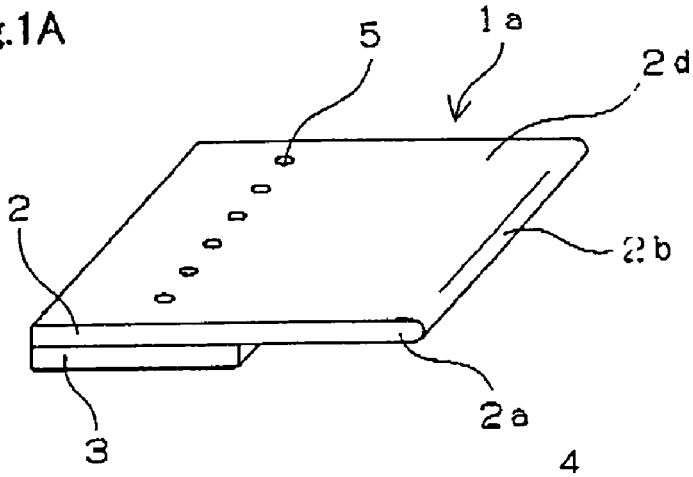
FIG. 1A, FIG. 1B, FIG. 1C and FIG. 1D show the process of manufacturing a plate-shaped peeling member of the present invention.

The method for manufacturing a plate-shaped peeling member of the present invention is described below with reference to FIG. 1A, FIG. 1B, FIG. 1C and FIG. 1D. FIG. 1A to FIG. 1D show the process of manufacturing the plate-shaped peeling member.

In a plate-shaped peeling member 1, except a free end portion 2*a* of a thin metal plate 2, the thin metal plate 2 is joined with a supporting member 3 by laser spot welding. A resin sheet 4 is adhered to upper and lower surfaces of the free end portion 2*a* by winding the resin sheet 4 around a leading edge 2*b* forming one side of the thin metal plate 2 from the upper surface of the free end portion 2*a* toward the lower surface thereof. Reference numeral 5 denotes a trace formed by laser spot welding.

Examples of a material of the thin metal plate include iron, aluminum, copper, stainless steel and the like. Preferably, the metal plate has a thickness within the range of 50 to 300 μm. If the thickness of the metal plate is less than 50 μm, it cannot provide sufficient pressure welding to the roller to ensure peeling ability. If the thickness exceeds 300 μm, the paper to be peeled may bump against the tip of the plate-shaped peeling member 1, which may cause jamming.

The thin metal plate 2 is joined with the supporting member 3 by laser spot welding. It is preferable that a plurality of spots be formed in parallel with a side in contact or adjacent with/to the roller in order to suppress waving of the thin metal plate 2. Also, it is preferable that the space between the spots be narrow as long as the laser spot welding can be conducted. Specifically, when the plate-shaped peeling member having a length of about 300 mm in its longitudinal direction is used, the space between the spots is preferably about 10 mm.

A base material 1*a* having the thin metal plate 2 joined with the supporting member 3 by the laser spot welding is prepared (see FIG. 1A).

Figure 1B:
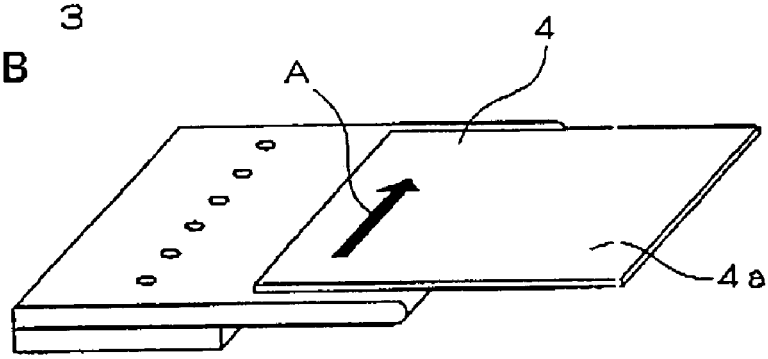

Thereafter the adhesive agent-applied resin sheet 4 shorter than the length of one main surface 2*d* of the thin metal plate 2 in its longitudinal direction A is adhered to the one main surface 2*d* by applying a pressure to the adhesive agent-applied resin sheet 4 in the longitudinal direction A, while an operator is performing an operation of bonding an adhesive layer of the adhesive agent-applied resin sheet to the one main surface 2*d* and not bonding a portion (non-adhered portion) 4*a* of the adhesive agent-applied resin sheet 4 to the thin metal plate 2 (see FIG. 1B).

As the resin sheet, a fluororesin sheet is preferable because it has excellent anti-tacking property to the developer. As the fluororesin sheet, it is preferable to use a sheet made of at least one resin selected from the group consisting of polytetrafluoroethylene polymer (hereinafter referred to as "PTFE"), tetrafluoroethylene-perfluoroalkylvinylether copolymer, tetrafluoroethylene-hexafluoropropylene copolymer, and tetrafluoroethylene-ethylene copolymer.

Among the fluororesin sheet described above, the sheet composed of the PTFE is suitable for use in the plate-shaped peeling member of the present invention, since the sheet composed of the PTFE has excellent anti-tacking properties to the developer and sufficient heat-resistance.

It is preferable to treat the surface of the fluororesin sheet which is adhered to the thin metal plate. The "surface treatment" herein is a treatment to improve adhesion effectiveness, when the fluororesin sheet is bonded to the thin metal plate with a silicone based adhesive described later. It is possible to use corona discharge, sputter etching, plasma etching, TOS treatment with metal sodium, and ultraviolet ray irradiation.

The fluororesin sheet has preferably a thickness in the range of 10 to 200 μm, more preferably in the range of 40 to 80 μm. If the thickness of the fluororesin sheet is less than 10 μm, the sheet may be broken by abrasion with the developer, and the thin-metal plate may be exposed by slight wearing. Also, the sheet may be crumpled at a step of sticking it to the thin metal plate, and may be handled with difficulty. If the thickness exceeds 200 μm, paper peeling ability decreases.

FIG. 2A, FIG. 2B, FIG. 2C and FIG. 2D show the sticking process shown in FIG. 1B. FIG. 2A to FIG. 2D are sectional views showing the process at the time when the resin sheet 4 is adhered to the thin metal plate 2.

Figure 2A:
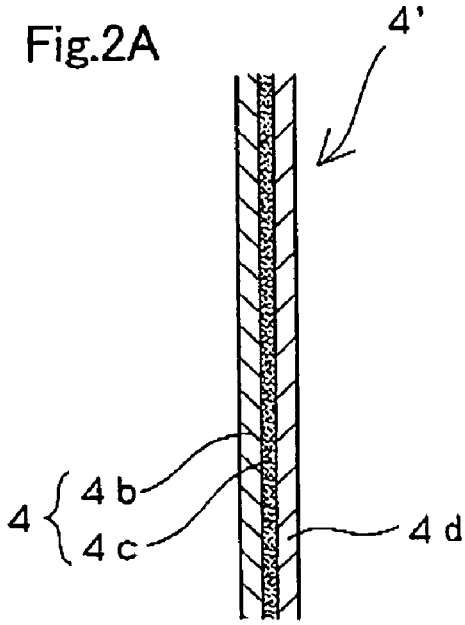
FIG. 2A, FIG. 2B, FIG. 2C and FIG. 2D are sectional views showing the process of adhering a resin sheet to a thin metal plate.
Figure 2B:
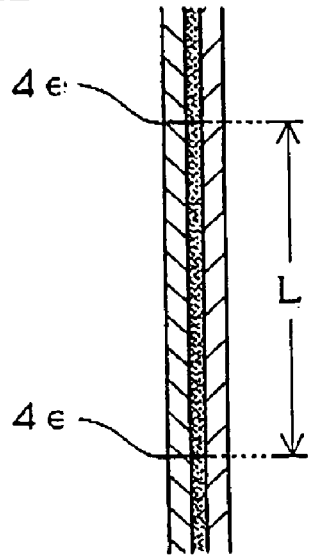
Figure 2C:
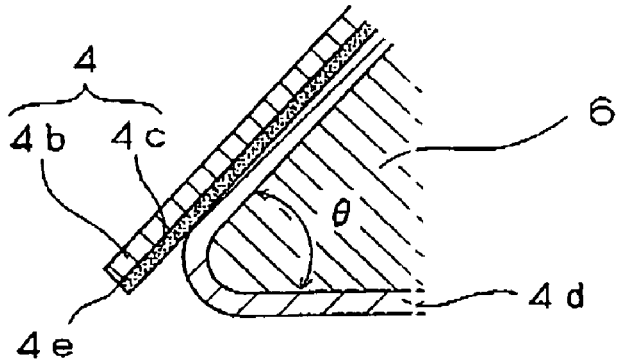
Figure 6:
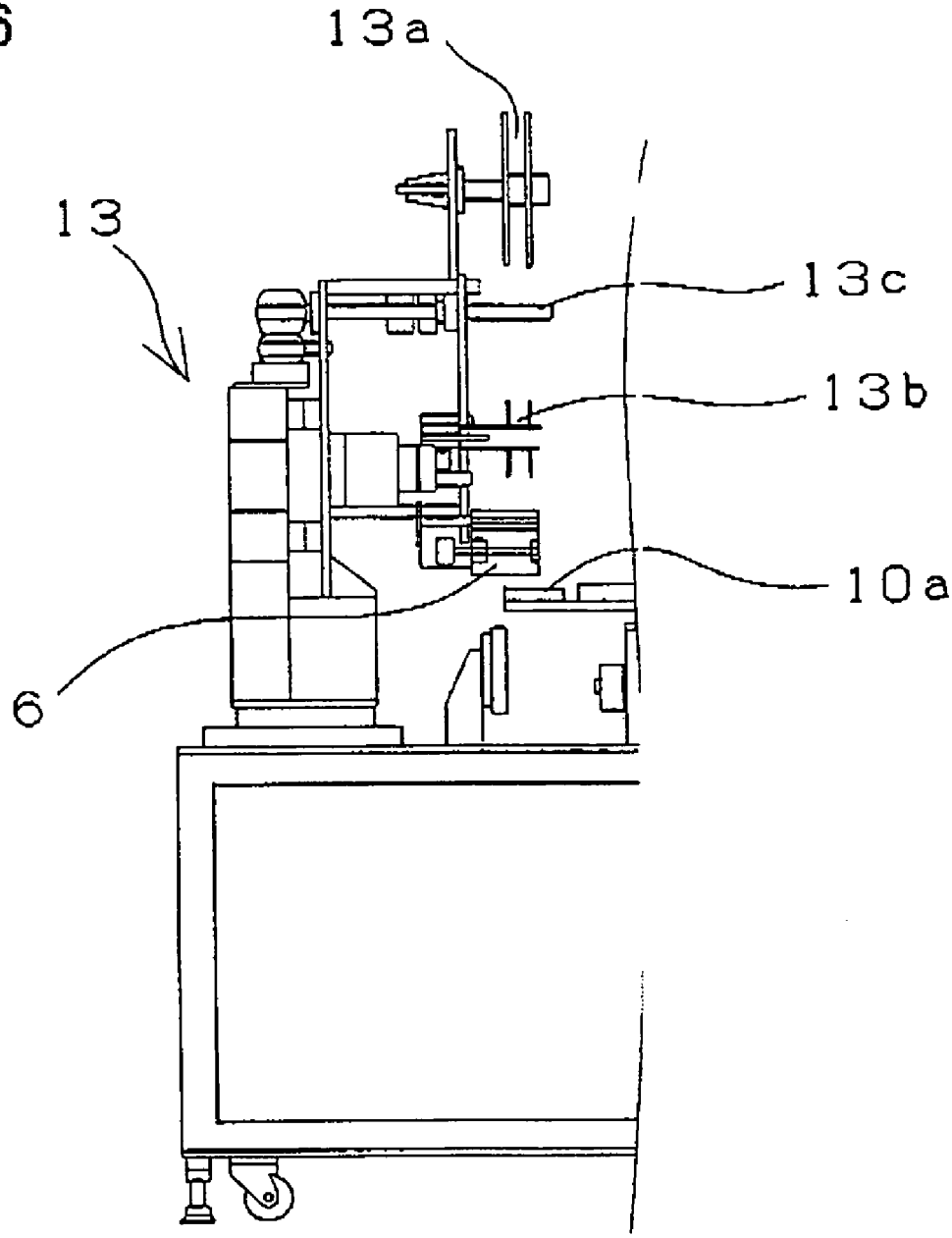
FIG. 6 shows a second means of the apparatus shown in FIG. 5.

Before the adhesive agent-applied resin sheet 4 is adhered to the thin metal plate 2, the adhesive agent-applied resin sheet 4 is wound around a tape supply reel 13*a* shown in FIG. 6 as a composite tape 4' (see FIG. 2A and FIG. 6). The composite tape 4' includes a resin sheet portion 4*b*, an adhesive layer 4*c*, and a peeling paper 4*d* sequentially layered one upon another. The composite tape 4' is wound around the tape supply reel 13*a* with the peeling paper 4*d* disposed on the innermost layer of the composite tape 4'. The resin sheet portion 4*b* is bonded to the thin metal plate 2 through the adhesive layer 4*c*, while the peeling paper 4*d* is being separated from the adhesive layer 4*c*.

Nicks 4*e* are formed in the resin sheet portion 4*b* of the composite tape 4' and the adhesive layer 4*c* thereof. The length between the adjacent nicks 4*e* is set a little shorter than the length of the thin metal plate 2 in its longitudinal direction (see FIG. 2B). At this time, the nick 4*e* is not formed in the peeling paper 4*d*. Therefore the peeling paper 4*d* allows the resin sheet 4 to keep the length L without expanding or contracting the resin sheet 4.

With a pawl member 6 having a predetermined angle θ being pressed against the composite tape 4' in the direction from the side of the peeling paper 4*d*, the composite tape 4' is wound around a winding reel 13*b* shown in FIG. 6 along the leading end of the pawl member 6. At the same time, the resin sheet 4 separates from the nicks 4*e* and also from the peeling paper 4*d*, with the adhesive layer 4*c* of the resin sheet 4 disposed at the side of the thin metal plate 2. The adhesive agent-applied resin sheet 4 separated from the peeling paper 4*d* is adhered to the thin metal plate 2 by moving the pawl member 6 in the direction shown with the arrow A along the surface of the thin metal plate 2, while the peeling paper 4*d* is being wound around the winding reel 13*b*. At the same time, the peeling paper 4*d* is wound around an unshown tape-winding reel (see FIG. 2C). The angle θ at the leading end of the pawl member 6 is set in consideration of the repulsion thereof attributed to the material of the tape or the thickness thereof. Thereby the peeling paper 4*d* can be separated from the composite tape 4'.

Figure 2D:
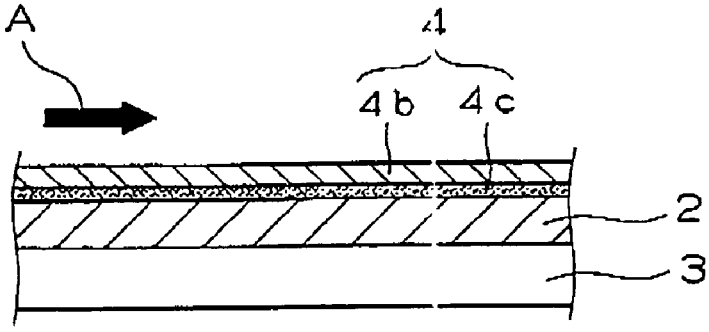

The adhesive layer 4*c* is adhered to the thin metal plate 2 by applying a pressure to the adhesive agent-applied resin sheet 4 in the longitudinal direction A of the thin metal plate 2 (see FIG. 2D). FIG. 2D is a sectional view showing the plate-shaped peeling member seen in the longitudinal direction thereof. In adhering the adhesive layer 4*c* to the thin metal plate 2, the front side of the pawl member 6 having the angle θ moves in the longitudinal direction of the thin metal plate 2. This method allows the peeling paper 4*d* to be separated from the composite tape 4' and the adhesive agent-applied resin sheet 4 to be adhered to the thin metal plate 2 without the resin sheet 4 being pulled. Therefore the adhesive agent-applied resin sheet 4 does not expand or contract, even though the adhesive agent-applied resin sheet 4 is adhered to the thin metal plate 2 by applying a pressure to the adhesive agent-applied resin sheet 4 in the longitudinal direction A.

Figure 1C:
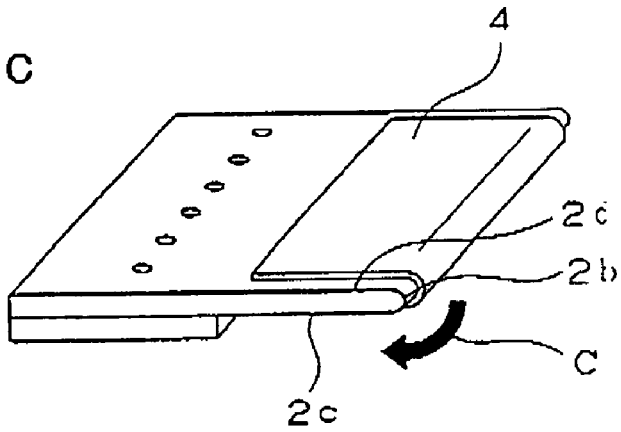

Thereafter the adhesive agent-applied resin sheet 4 is temporarily adhered to the thin metal plate 2 by folding back the non-adhered portion 4*a* of the adhesive agent-applied resin sheet 4 along the leading edge 2*b* of the thin metal plate 2 toward other main surface 2*c* (see FIG. 1*c*).

Figure 3A:
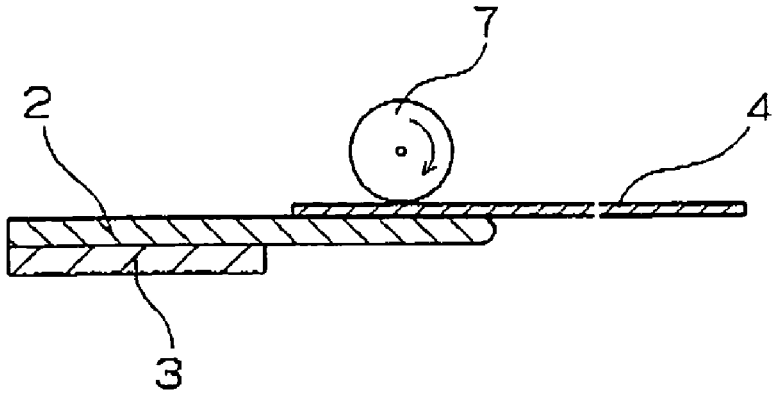
FIG. 3A and FIG. 3B are widthwise sectional views showing the process of temporarily adhering the resin sheet to the thin metal plate.
Figure 3B:
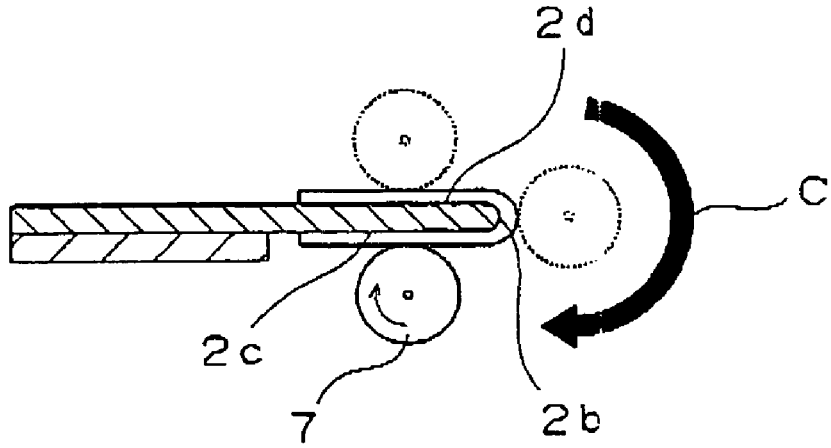

FIG. 3A and FIG. 3B show the temporary adhering process shown in FIG. 1C. FIG. 3A and FIG. 3B are widthwise sectional views showing the process of temporarily adhering the resin sheet to the thin metal plate.

The adhesive agent-applied resin sheet is temporarily adhered to the thin metal plate 2 by using a roller 7 having a shaft parallel with the longitudinal direction of the thin metal plate 2 (see FIG. 3A).

The roller 7 rotates and moves from an upper surface of the adhesive agent-applied resin sheet 4 along the leading edge 2*b* to the other main surface 2*c* of the thin metal plate 2, with the roller 7 being pressed against the adhesive agent-applied resin sheet 4 (see FIG. 3B). As a result, the resin sheet 4 is adhered to the leading edge 2*b* of the thin metal plate 2 and both main surfaces 2*d* and 2*c* thereof.

Figure 1D:
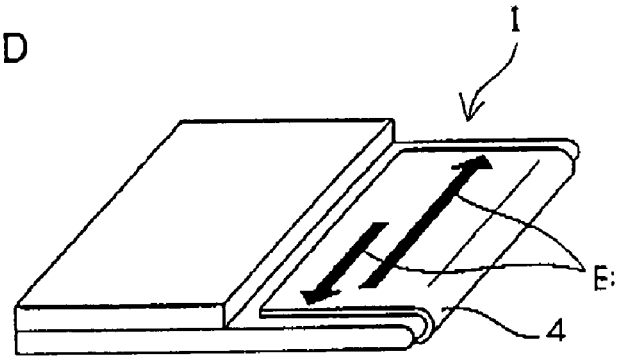

To bond the resin sheet 4 fixedly to the thin metal plate 2 strongly, the other main surface 2*c* to which the non-adhered portion 4*a* of the resin sheet 4 has been temporarily adhered is pressurized in the longitudinal direction B of the adhesive agent-applied resin sheet 4 from approximately the center thereof in its longitudinal direction B (see FIG. 1D).

Figure 4:
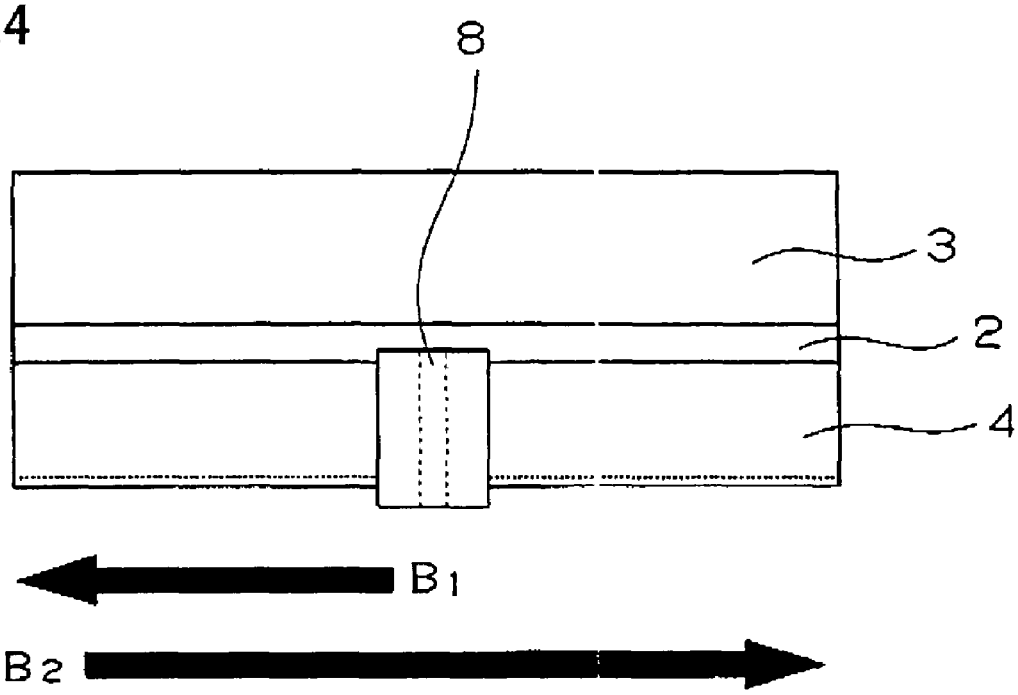
FIG. 4 is a widthwise sectional view showing the process of temporarily adhering the resin sheet to the thin metal plate.

FIG. 4 shows the pressurizing process. FIG. 4 is a sectional view showing the process of temporarily sticking the resin sheet to the thin metal plate when the plate-shaped peeling member is seen from the other main surface 2*c*.

As the pressurizing means, the pressurizing roller 8 is used. The pressurizing roller 8 having a shaft in the widthwise direction of the resin sheet 4 is moved in the longitudinal direction thereof, while the pressurizing roller 8 is rotating. At this time, the pressurizing roller 8 is moved in the direction shown with the arrow $B_1$ from approximately the center of the adhesive agent-applied resin sheet 4 in its longitudinal direction. Thereafter the pressurizing roller 8 is moved in the direction shown with the arrow $B_2$ from one end of the adhesive agent-applied resin sheet 4. This method makes it possible to manufacture the plate-shaped peeling member in which the generation of wrinkles and bubbles in the resin sheet 4 is suppressed to the highest possible extent. The pressurizing roller 8 may be moved in the direction shown with the arrow $B_1$ from approximately the center of the adhesive agent-applied resin sheet 4 in its longitudinal direction and then in the direction shown with the arrow $B_2$ from approximately the center of the adhesive agent-applied resin sheet 4.

When manufacturing the plate-shaped peeling member 1 which does not have the supporting member 3, the above-described method allows the adhesive agent-applied resin sheet 4 to be adhered to the thin metal plate 2 from the leading edge 2*b* thereof to the other main surface 2*c* thereof.

In the plate-shaped peeling member 1 obtained by the above-described manufacturing method, the resin sheet 4 is adhered to the thin metal plate 2 by winding the resin sheet 4 around the leading edge 2*b* of the thin metal plate 2. The resin sheet 4 is adhered to the thin metal plate 2 in a length a little shorter than that of the thin metal plate 2 in its longitudinal direction. Therefore a metal ground is exposed at both end surfaces of the thin metal plate 2 in its longitudinal direction. Because both ends of the resin sheet 4 in its longitudinal direction are not pulled in adhering the resin sheet 4 to the thin metal plate 2, the resin sheet 4 adhered to the thin metal plate 2 does not contract in its longitudinal direction. Even when the adhesive force deteriorates or is nonuniform, the resin sheet 4 does not contract. Therefore the adhesive agent is not exposed and hence toner does not attach to the adhesive agent. Thus the paper is not stained.

As described above, the plate-shaped peeling member of the present invention is capable of accomplishing a sufficient line contact with a fixing member such as a fixing roller and does not damage it at the portion where the plate-shaped peeling member contacts the fixing member. Further the plate-shaped peeling member is capable of maintaining superior peeling performance for a long time and preventing toner from contaminating paper.

Figure 5:
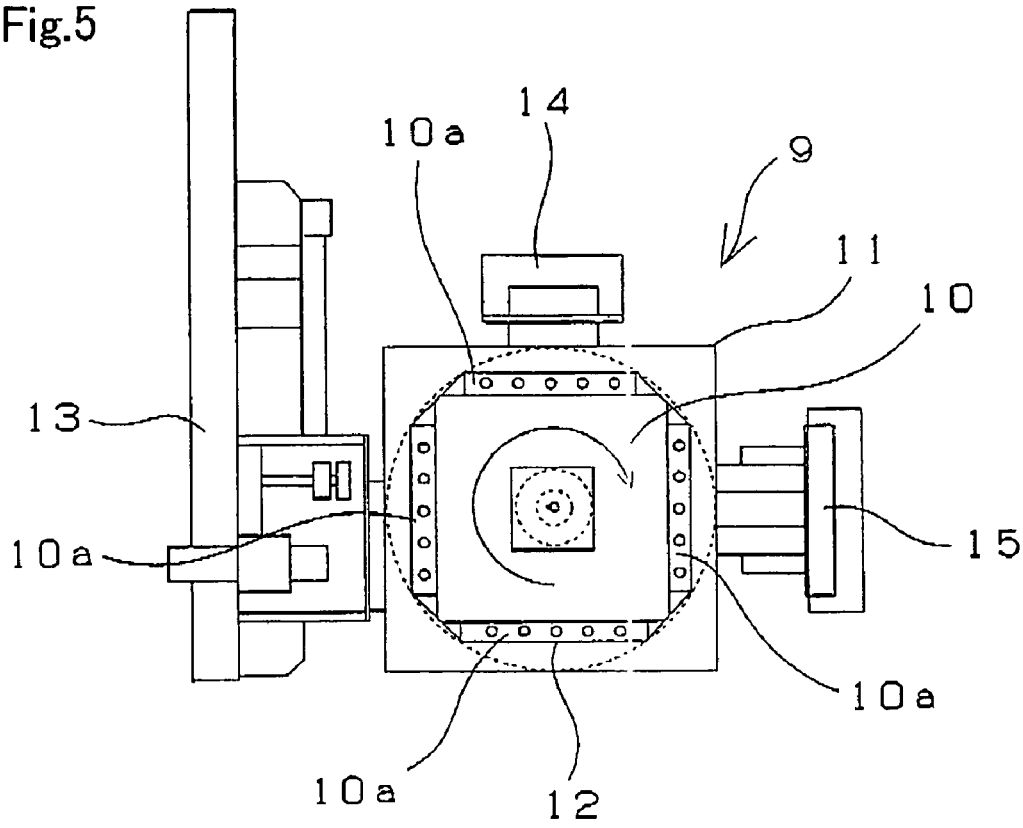
FIG. 5 is a plan view showing an apparatus for manufacturing the plate-shaped peeling member.

An apparatus for manufacturing the plate-shaped peeling member is described below with reference to FIG. 5 and FIG. 6. FIG. 5 is a plan view showing the apparatus for manufacturing the plate-shaped peeling member. FIG. 6 shows a second means of the apparatus for manufacturing the plate-shaped peeling member.

The apparatus for manufacturing the plate-shaped peeling member has a rotary body 10 which is mounted on a square stand 11. A placing base 10*a* for placing the thin metal plate 2 thereon and fixing it thereto is provided on each of four sides thereof. The rotary body 10 rotates 90 degrees at a time.

The apparatus for manufacturing the plate-shaped peeling member has a first means 12, a second means 13, a third means 14, and a fourth means 15 so disposed as to surround the four sides of the square stand 11 respectively.

The first means 12 takes out a product from the placing base 10*a* and mounts the thin metal plate joined with the supporting member 3 or the thin metal plate on the placing base 10*a*. A vacuum suction fixing method or the like can be adopted to mount the thin metal plate or the like on the placing base 10*a*.

The second means 13 carries out the process shown in FIG. 2A to FIG. 2D. The second means 13 has the composite tape 4', the tape supply reel 13*a*, a cutting means 13*c* for cutting the thin metal plate in its longitudinal direction, the pawl member 6 for sticking the resin sheet 4 to the thin metal plate, while it is peeling the peeling paper 4*d*, and the winding reel 13*b*. The second means 13 has a portion for moving the second means 13 in the longitudinal direction of the thin metal plate.

The third means 14 carries out the process shown in FIG. 3A and FIG. 3B. It is possible to use an apparatus as the third means 14, provided that the apparatus is capable of temporarily sticking the adhesive agent-applied resin sheet 4 to the thin metal plate 2 by folding back the non-adhered portion 4*a* thereof along the leading edge 2*b* of the thin metal plate 2.

The fourth means 15 carries out the process shown in FIG. 4. It is possible to use an apparatus as the fourth means 15, provided that the apparatus is capable of moving from approximately the center of the adhesive agent-applied resin sheet 4 in its longitudinal direction to apply pressure to the adhesive agent-applied resin sheet 4 in fixedly adhering the adhesive agent-applied resin sheet 4 to the thin metal plate 2.

The plate-shaped peeling member of the present invention is capable of accomplishing a sufficient line contact with a fixing member such as a fixing roller and does not damage it at the portion where the plate-shaped peeling member contacts the fixing member. Further the plate-shaped peeling member is capable of maintaining its superior peeling performance for a long time. That is, the plate-shaped peeling member is durable. Thus the plate-shaped peeling member is applicable to an electrophotographic apparatus such as a copy machine and a laser beam printer Since the method of manufacturing the plate-shaped peeling member of the present invention has the above-described processes, the method is capable of suppressing the generation of wrinkles and bubbles in the resin sheet and enhancing smoothness on the upper and lower surfaces of the plate-shaped peeling member. Consequently the method can be used to manufacture the plate-shaped peeling member for the electrophotographic apparatus capable of securely keeping the quality of a recorded image high.

What is claimed is:

1. A plate-shaped peeling member for peeling paper from a roller or a belt of an electrophotographic apparatus, with a leading end of said plate-shaped peeling member in contact with or adjacent to said roller or said belt, comprising:

a thin metal plate with an applied resin sheet adhered around the leading end of said thin metal plate with an adhesive agent, said applied resin sheet having a length a little shorter than that of said thin metal plate in a longitudinal direction thereof a metal ground exposed on each side of said applied resin sheet at both of the end surfaces of said thin metal plate in said longitudinal direction thereof.

2. A plate-shaped peeling member as claimed in claim 1, wherein said thin metal plate has a thickness in a range of 50 μm to 300 μm.

3. A plate-shaped peeling member as claimed in claim 2, wherein said thin metal plate is joined to a supporting member made by laser spot welding.

4. A plate-shaped peeling member as claimed in claim 1, wherein said applied resin sheet is a fluororesin sheet.

5. A plate-shaped peeling member as claimed in claim 4, wherein said fluororesin sheet has a thickness of 10 μm to 200 μm.

* * * * *